United States Patent [19]

Taylor

[11] 4,053,169

[45] Oct. 11, 1977

[54] COMBINED GOLF BAG AND CART MECHANISM

[76] Inventor: Clarence R. Taylor, 28 Woodside Drive, Penfield, N.Y. 14526

[21] Appl. No.: 673,583

[22] Filed: Apr. 5, 1976

[51] Int. Cl.[2] ..... B62B 11/00

[52] U.S. Cl. ..... 280/37; 280/38; 280/DIG. 6

[58] Field of Search ..... 280/37, 38, 645, 646, 280/40, 65, DIG. 6; 305/15, 16, 60, 35, 37

[56] References Cited

U.S. PATENT DOCUMENTS

| | | | |
|---|---|---|---|
| 2,602,676 | 7/1952 | Fieldhouse | 280/652 |
| 2,760,782 | 8/1956 | Hartzell | 280/37 |
| 2,838,345 | 6/1958 | Miller | 305/17 |
| 3,014,732 | 12/1961 | Schemenauer | 280/DIG. 6 |

*Primary Examiner*—Robert R. Song

[57] ABSTRACT

A combined golf bag and cart mechanism in which the bag and cart are permanently coupled to one another. The bag provides a rigid support for the cart and is provided with a cavity. The cart is movable between a retracted position in which the cart wholly nests within the cavity, and an extended position in which the cart supports the bag for transport. The cart has a pair of substantially elliptically shaped wheels, and an orienting device for maintaining the wheels in planes parallel to the axis of the cavity in both the retracted and extended positions of the cart.

12 Claims, 21 Drawing Figures

COMBINED GOLF BAG AND CART MECHANISM

BACKGROUND OF THE INVENTION

1. Field of the Invention

This invention relates generally to golf bags and carts, and more specifically to a golf bag an cart mechanism in which the bag and cart are permanently coupled to one another.

2. Description of the Prior Art

It is known in the prior art to provide a combined golf bag and cart mechanism in which the cart has a frame for supporting a box-shaped bag secured thereto. It is further known to provide a golf cart which is movable between retracted and extended positions to facilitate transport of the cart in a car or the like. Some of the disadvantages of the aforementioned combined golf bag and cart mechanism, particularly when filled with golf clubs, is that its weight and bulkiness makes it difficult (1) to lift and carry the mechanism (2) to pull the mechanism on a golf coarse and (3) to store or ship the mechanism in a common carrier such as a car. In those situations where individual golf bags and carts are used, it is difficult and inconvenient to ship or transport both the bag and cart for vacation use, normally resulting in the cart being left at home during travel and another cart rented at the destination.

SUMMARY OF THE INVENTION

In accordance with preferred embodiments of the invention, a combined golf bag and cart mechanism is disclosed in which the bag and cart are permanently coupled to one another to form a unitary mechanism. The bag is rigid and provided with an elongated cavity, and the cart is movable between a retracted position in which the cart wholly nests within the cavity, and an extended position in which the cart supports the bag for transport. The cart is provided with a pair of substantially elliptically-shaped wheels, and is further provided with orienting means for supporting and coupling the wheels to the cart and maintaining the wheels in planes parallel to the axis of the cavity in both the retracted and extended positions of the cart. This is necessary to assure proper seating of the wheels in the bag cavity. In one embodiment, the orienting means comprises a first support lever having one end pivotally supported on a first pivot pin on the bag, a second lever pivotally supported intermediate its ends by the opposite end of the first lever and having one end coupled to the wheel, and a third orienting lever having one end pivotally coupled to the opposite end of the second lever, and its other end pivotally supported by the bag on a second pivot pin spaced from the first pivot pin. The cart is further provided with flexible means interconnecting the first support levers to prevent excessive spreading of the levers and wheels in the extended position of the cart. Each of the first support levers is futher provided with telescopable support rod portions for coupling the lever to the bag, and which may be secured together for rigidly supporting the first lever and wheel in the extended position of the cart. The wheels each further comprise a hub mounted for rotatable movement on one end of the second lever and having a substantially elliptical peripheral rim, and a tire rotatably mounted on the rim. In one embodiment, at least one endless wire is interposed between the rim and the corresponding periphery of the tire. In another embodiment, either the rim or tire is provided with a peripheral rib, and its counterpart is provided with a peripheral groove for receiving the rib. Each wheel is further provided with seal means coupling the hub to the tire to prevent dirt from entering between the rib and the corresponding periphery of the tire, and in some instances to assist in holding the tire on the rim. Each wheel may further be provided with lubricating elements interposed between the rim and the corresponding periphery of the tire.

One of the advantages of the present invention is to provide a combined golf bag an cart mechanism in which its weight is minimal, varying from about five to seven pounds. Further advantages of the present invention is that the bag provides a support or backbone for the cart, and the cart completely or wholly nests within the cavity in the bag to provide a unitary cylindrical member that may be easily transported by common carriers such as trains, cars or airplanes. Another advantage of this invention is that the necessity for renting a cart at a destination point is eliminated. A further advantage of the invention is to provide a combined golf bag and cart mechanism having an improved wheel design, thereby requiring less force to pull the mechanism over hilly and irregular terrain. The invention and these and other advantages will become more apparent from the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Because golf bags and carts are well-known, the present description will be directed to elements forming part of, or cooperating more directly with, apparatus in accordance with the present invention. Golf bag and cart elements not specifically shown or described should be understood to be selectable from those known in the art.

Figures 1, 2, 3, 4, 5, 6, 7, 8, 9:
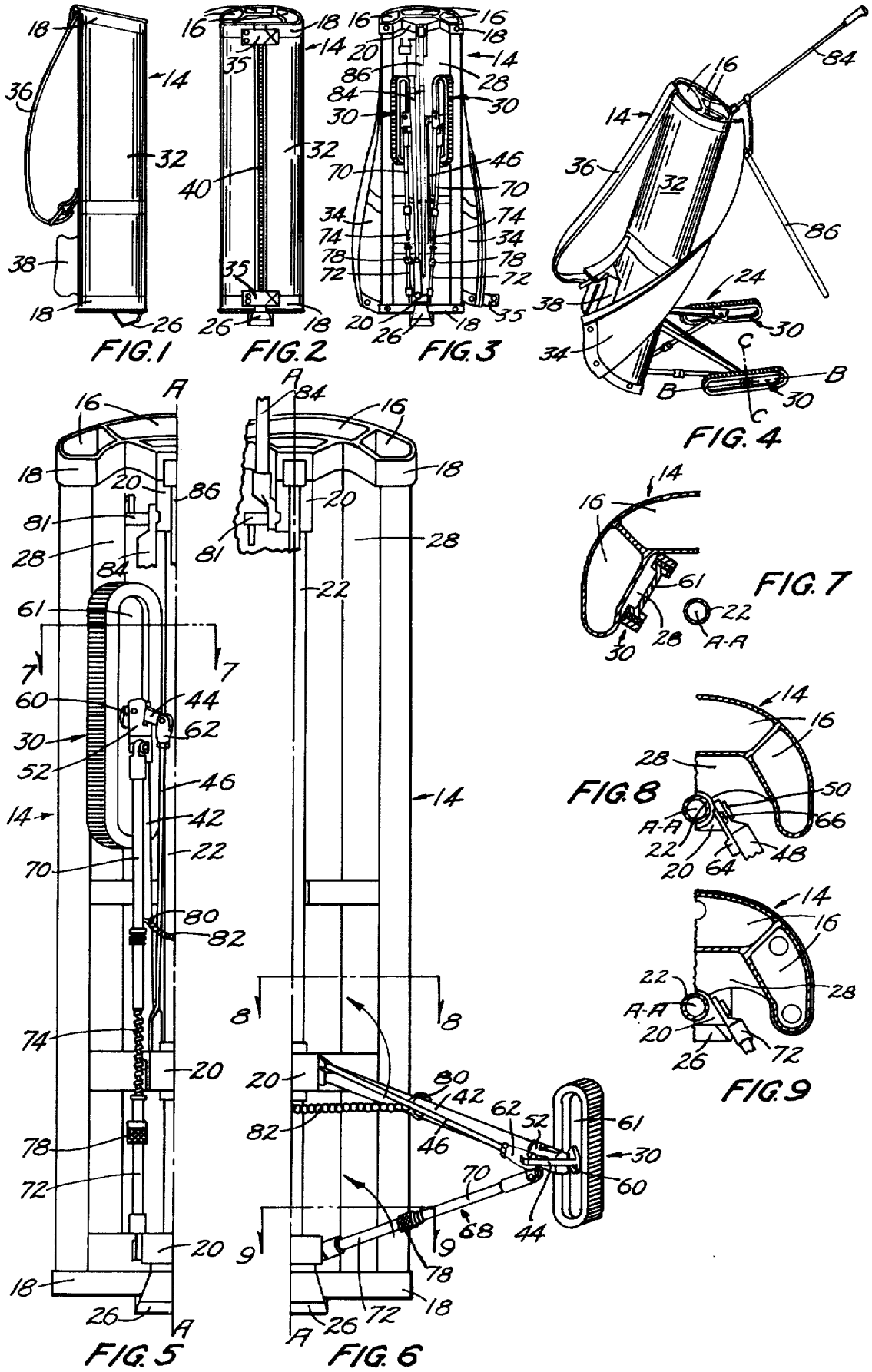
FIG. 1 is a side elevational view of a preferred embodiment of the combined golf bag and cart mechanism of this invention with the cart in its retracted position.
FIG. 2 is a front elevational view of the mechanism of FIG. 1 with the cover flap closed.
FIG. 3 is a view similar to FIG. 2 with the flap opened and showing the cart in its retracted position.
FIG. 4 is a perspective view of the golf bag and cart mechanism with the cart in its extended position.
FIG. 5 is an enlarged view of one half of the mechanism of FIG. 3.
FIG. 6 is a view similar to FIG. 5 of the other half of the mechanism with the cart partially pivoted from its extended position toward its retracted position.
FIG. 7 is a selection view taken substantially along line 7—7 of FIG. 5.
FIG. 8 is a section view taken substantially along line 8—8 of FIG. 6.
FIG. 9 is a section view teken substantially along line 9—9 of FIG. 6.

With reference to FIGS. 1-12 of the drawings, a preferred embodiment of the combined golf bag and cart mechanism of this invention is disclosed. The mechanism comprises an elongated golf bag 14 of a substantially C-shaped cross-section throughout its length and preferably formed from any suitable material such as plastic or metal by any suitable process such as an extrusion process, or fabricated from rolled sheet material. The bag 14 is preferably provided with compartments 16 for receiving golf clubs, not shown, and toward this end the bag may be formed from a plurality of tubular members, now shown, secured together along their edges and each adapted to hold one or more golf clubs. The bag 14 is preferably provided with top and bottom peripheral rims 18 formed from plastic or the like by injection molding or some other process, and the rims and a rigid member interposed therebetween include anchors 20 for supporting a rigid tube 22 and portions of a cart 24. If the bag is constructed with sufficient rigidity the support tube 22 may be dispensed with. The bottom rim 18 may further be provided with an integrally formed impact nose member 26 for supporting the golf bag and cart mechanism when held in an upright folded or retracted position. The bag 14, by virtue of its substantially C-shaped cross-section, provides an elongated cavity 28 as best seen in FIGS. 7-9 extending along a longitudinal axis A—A into which cart 24 wholly nests when it is moved to its retracted position. In this retracted position (FIGS. 3 and 5) all portions of cart 24 including the wheels 30 are nested within cavity 28 so that no portion of the cart extends radially outwardly from axis A—A of bag 14 further than the radius of the bag. Consequently, the golf bag and cart mechanism, when folded or retracted, forms a compact, substantially cylindrical member (FIGS. 1 and 2) to facilitate handling and transport of the mechanism. The bag 14 is preferably provided with a decorative cover 32 of leather or the like having flaps 34 (FIGS. 3 and 4) to cover cavity 28, a strap 36 by which the mechanism can be carried, and one or more pockets 38 integral with the bag or attachable thereto by any suitable means such as Velcro hook and loop fasteners. The flaps 34 can be joined together by a zipper 40 or by snaps and tabs 35. Alternatively, bag 14 could be extruded and provided with a surface finish that resembles cover material. One or more flaps 34 would span the cavity 28 to hold cart 24 therein. The bag could be provided with a cap enclosing the golf clubs. For shipping, a separate bag, not shown, would be available for completely enclosing the bag and cart mechanism. Such a bag could be made large enough to carry other golf equipment such as clothing or the like.

The cart 24 of the golf bag and cart mechanism comprises a pair of substantially elliptically-shaped wheels 30, and orienting means comprising first, second and third levers 42, 44 and 46 respectively (FIGS. 5, 6 and 10) for supporting and coupling wheels 30 to bag 14. Wheels 30 and levers 42, 44 and 46 are movable between extended and retracted positions. They form supporting means for the bag and cart mechanism in its extended position, and orienting means for maintaining wheels 30 in planes parallel to cavity axis A—A in both the retracted and extended positions of the bag and cart mechanism. This is necessary to assure proper entry of wheels 30 into cavity 28 with the long axis B—B (FIG. 4) of hub 6 substantially parallel to the axis A—A of cavity 28. The first lever 42 has one end 48 pivotally mounted on an anchor pivot pin 50 (FIG. 11) and its opposite end 52 (FIG. 10) pivotally supporting second lever 44 on a pivot pin 54 intermediate the ends 56, 58 of second lever 44. End 56 of lever 44 provides an axle 60 for rotatably supporting wheel hub 61, and its opposite end 58 is pivotally coupled to one end 62 of third lever 46. The other end 64 of lever 46 is pivotally mounted on an anchor pin 66 (FIG. 11) spaced from pin 50.

A pair of telescopable holding rods 68 (FIGS. 5 and 6) are provided for support levers 42, each rod 68 comprising two hollow telescopable parts 70, 72 biased together by a spring 74 (FIG. 5). One part 70 is connected to a boss projecting from lever end 52 and the other part 72 is pivotally connected to lower bag anchor 20. The two parts 70, 72 may be latched together by a nut 78 on part 72 engaging a threaded portion on part 70 in the extended position of cart 24 to provide a rigid support for wheels 30 (FIG. 6). The parts 70, 72 may also be detached upon unscrewing of nut 78 (FIG. 5) to provide outward movement of one part relative to the other to allow movement of cart 24 into its retracted position. To prevent lateral outward or spreading movement of wheels 30 in the extended position of the cart, wheel levers 42 and middle anchor 20 may be provided with eyelets 80 for receiving an endless chain 82. A handle 84 (FIGS. 4, 5, 6 and 12) may be pivotally secured by a wing nut 81 to upper anchor 20, and to minimize the load to which the handle is subjected in the event the mechanism tips, a support rod 86 may be provided, also pivotally secured to upper anchor 20. This support rod 86 further can be used to support the mechanism in a rest position if desired. To prevent undue spreading, tube 22 handle 84 and rod 86 can be interconnected by chains 83.

Figure 13:
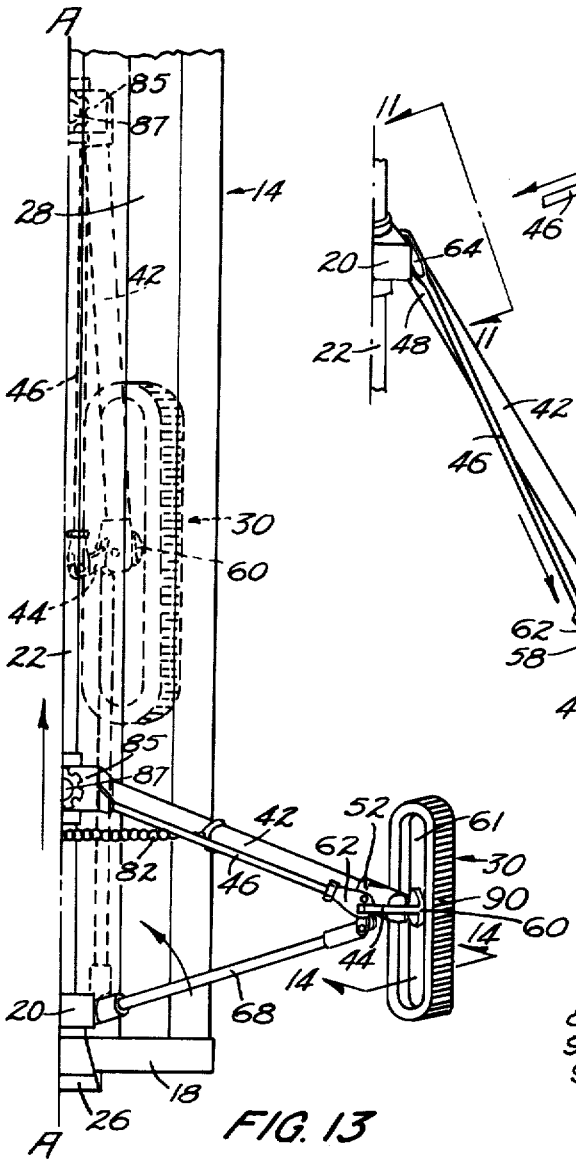
FIG. 13 is a segmental side elevational view similar to FIG. 6 of another embodiment of the cart.
Figure 10:
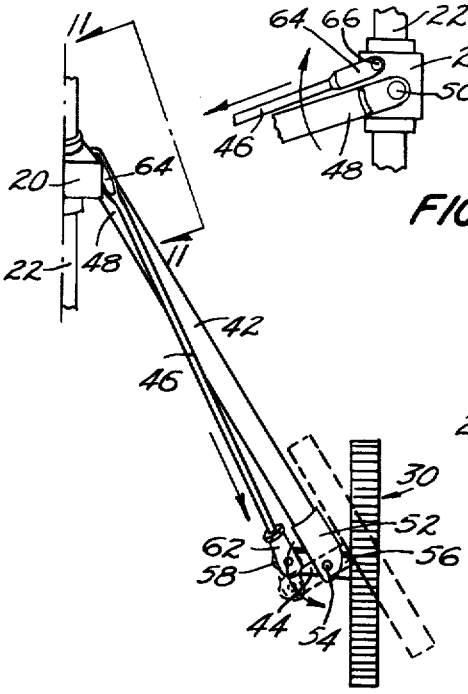
FIG. 10 is a segmental enlarged elevational view showing in full lines a portion of the cart wheel orienting means in its extended position, and showing in dotted lines the position assumed by part of the orienting means when the cart is moved to its retracted position.
Figure 11:
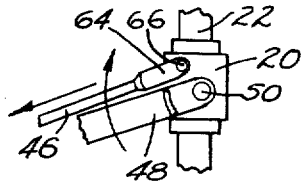
FIG. 11 is a segmental view of a portion of the orienting means of FIG. 10 looking at it from line 11—11.
Figure 12:
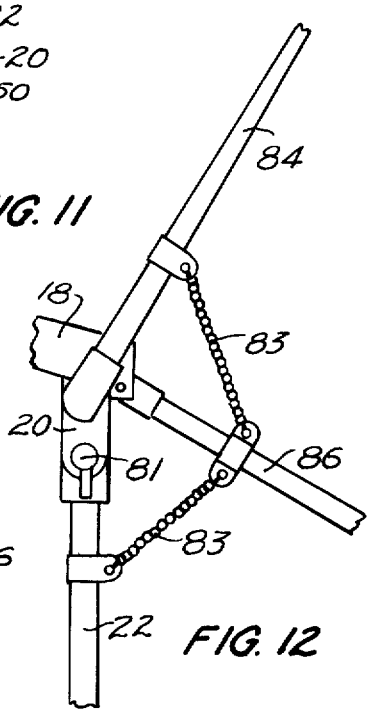
FIG. 12 is a segmental side elevation view showing the handle and support rod secured to the support tube.

With reference to FIG. 13, another embodiment of cart 24 is disclosed showing an alternate cart folding mechanism. In this embodiment, ends of wheel support levers 42, 46 are secured to an anchor 85 which is slideably mounted on support tube 22. The anchor 85 is provided with a nut 87 for securing the anchor to the tube in the extended and retracted positions of wheels 30. Lever 68 is one piece in this design, and lever pivot pin 66 is positioned below lever pivot pin 50 rather than above it as in the embodiment illustrated in FIGS. 1-12 in order to maintain the wheel planes parallel to axis A—A in both the extended and retracted positions of the cart.

Figure 14:
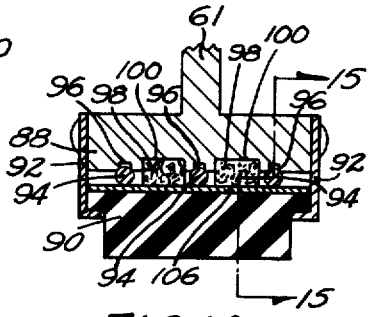
FIG. 14 is an enlarged segmental section view of a cart wheel taken substantially along a line 14—14 of FIG. 13.
Figure 15:
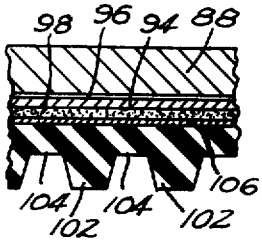
FIG. 15 is a segmental section view taken substantially along line 15—15 of FIG. 14.
Figure 17:
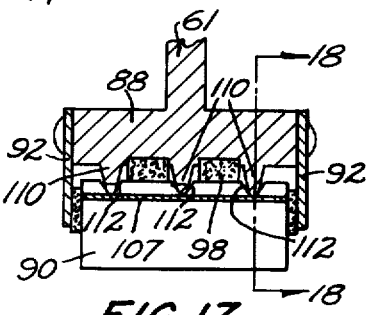
FIGS. 16, 17, 19 and 21 are segmental section views of alternate embodiments of the cart wheel of this invention.
Figure 18:
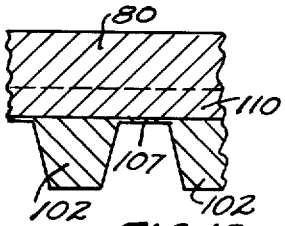
FIG. 18 is a section view taken substantially along line 18—18 of FIG. 17.
Figure 16:
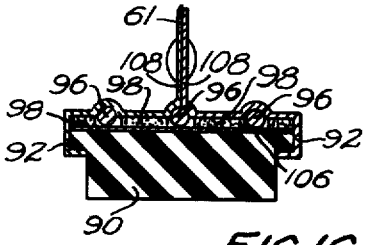
Figure 19:
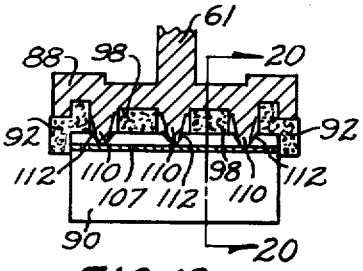
Figure 20:
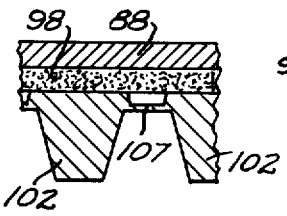
FIG. 20 is a section view taken substantially along line 20—20 of FIG. 19.
Figure 21:
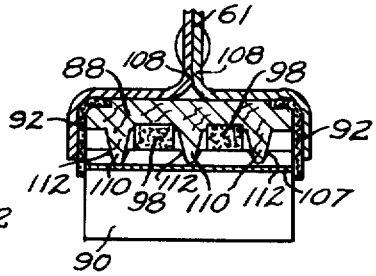

One of the reasons why the golf bag and cart mechanism of this invention is capable of being folded into such a compact package is because wheels 30 are elliptically shaped, and hence the smallest or short axis C—C (FIG. 4) of the wheel is capable of recessing into cavity 28. By virtue of this elliptical design, wheels 30 provide a riding quality equivalent to a pair of circular wheels having a diameter of substantially seven feet. Accordingly, on rough ground the rotatable tires 90 of elliptical wheels 30 skim over the rough surfaces and result in a very smooth ride without any appreciable bumping and swaying of cart 24. With reference to FIGS. 14 and 15, one embodiment of an elliptical wheel 30 is disclosed comprising rotatably mounted hub 61 having a peripheral rim 88. An endless tire 90 is rotatably mounted on rim 88 and held thereon by side seal members 92. Interposed between rim 88 and tire 90 are endless Nylon (trademark) wires 94 nesting within annular grooves 96 in the outer periphery of rim 88. A pair of endless lubricating members 98 comprising lubricant inpregnated felt or the like is interposed between rim 88 and tire 90 nesting within recesses 100 in rim 88 for lubricating the wire and the cooperating surfaces of the rim and tire. The tire 90 is preferably provided with tread portions 102 joined by thin wall portions 104 to add flexibility to the tire. The inner periphery of tire 90 may further be provided with a Teflon (trademark) layer 106 or sheet bonded thereto to improve the slideability of tire 90 on rim 88. The hub 61 and rim 88 are preferably formed from aluminum or nylon and tire 90 is preferably formed of rubber. In the alternative embodiment of wheel 30 illustrated in FIG. 16, hub 61 is formed from two sheet metal members 108 riveted together, and the ends of members 108 partially encircle side ribs of tire 90 at 92 for holding the tire on rim 88, and providing a dirt seal for preventing dirt from entering between the outer periphery of rim 88 and the inner periphery of tire 90. In the alternative embodiments of wheel 30 illustrated in FIGS. 17–21, hub members 61 all have a peripheral rim 88 formed of Nylon, Teflon or any other suitable material such as certain forms of wood, and tire 90 molded in one piece of suitable Nylon or Teflon material, with a thin section at 107 for flexibility. The rim 88 is provided with peripheral annular ribs 110 received by complementary annular gooves 112 in the inner periphery of tire 90. In these alternative embodiments, all parts similar to the parts illustrated in FIGS. 14 and 15 are denated by the same numerals, even though some small structural differences may be present, particularly in the configuration of the seal member 92. Although the elliptical wheel designs disclosed and described all have elliptically shaped hubs, it is of course possible to provide an elliptical hub formed by a plurality of rotatable wheels, not shown, adjacently mounted on a support plate rotatably mounted on lever end 46 and preferably provided with a single tire encircling the wheels or riding in peripheral grooves in the wheels.

The invention has been described in detail with particular reference to preferred embodiments, but it will be understood that variations and modifications can be effected within the spirit and scope of the invention as described.

What is claimed:

1. A combined golf bag and cart mechanism comprising:

a golf bag having an elongated peripheral cavity defining an axis;

a golf cart permanently secured to said bag and movable between a retracted position in which said cart wholly nests in said cavity, and an extended position in which said cart supports said bag for transport on said wheels, said golf cart further including a pair of wheels and orienting means for pivotally coupling each of said wheels to said bag and for maintaining each of said wheels in parallel planes relative to said axis;

said orienting means for each of said wheels further comprising a first lever having one end pivotally mounted on a first pivot pin on said bag, and a second lever pivotally connected to the opposite end of said first lever, said second lever having one end coupled to said wheel and the opposite end pivotally coupled to said bag on a second pivot pin spaced from said first pin; and rigid detachable support rods interconnecting said first lever of each of said wheels to said bag for supporting said first levers and said wheels in said extended position of said cart.

2. The mechanism according to claim 1 wherein each of said wheels comprises a hub mounted for pivotal movement and having a substantially elliptical peripheral rim and a tire rotatably mounted on said rim.

3. The mechanism according to claim 2 wherein at least one endless wire is interposed between said rim and the corresponding periphery of said tire.

4. The mechanism according to claim 3 wherein seal members couple said hub to said tire to prevent dirt from entering between said rim and said tire and to assist in holding said tire on said hub.

5. The mechanism according to claim 2 wherein one of said rim and said tire is provided with peripheral ribs.

6. The mechanism according to claim 5 wherein the other of said rim and said tire is provided with peripheral grooves for receiving said ribs.

7. The mechanism according to claim 6 wherein seal members couple said hub to said tire to prevent dirt from entering between said rim and said tire and to assist in holding said tire on said rim.

8. The mechanism according to claim 7 wherein lubricating elements are interposed between said rim and the corresponding periphery of said tire.

9. The mechanism according to claim 1 wherein said golf bag has a rigid anchor mounted in said cavity between the ends of said golf bag, said first pivot pin is mounted on said anchor, and said second pivot pin is mounted on said anchor and axially spaced from said first pivot pin whereby said first and second levers can be pivotally moved between said retracted and extended positions in a single movement.

10. The mechanism according to claim 9 and further comprising a third lever for each wheel having one end of said third lever pivotally connected to said opposite end of said second lever and having the opposite end of said third lever pivotally connected to said anchor by said second pivot pin.

11. A combined golf bag and cart mechanism comprising:

a golf bag having an elongated peripheral cavity defining an axis, rigid anchors at each end of said bag for supporting a rigid elongated pole in said cavity parallel to said axis and a slidable anchor slidably mounted on said pole;

a golf cart permanently secured to said bag and movable between a retracted position in which said cart wholly nests in said cavity, and an extended position in which said cart supports said bag for transport on said wheels, said golf cart further including a pair of wheels and orienting means for pivotally coupling each of said wheels to said bag and for maintaining each of said wheels in parallel planes relative to said axis;

said orienting means for each wheel further comprising a first lever having one end pivotally mounted on a first pivot pin on said slidable anchor, and a second lever pivotally connected to the opposite end of said first lever, said second lever having one end coupled to said wheel and the opposite end pivotally coupled to said slidable anchor on a second pivot pin on said slidable anchor axially spaced from said first pin whereby said first and second levers can be pivotally moved between said retracted and extended positions in a single movement; and rigid support rods interconnecting said first levers to one of said rigid anchors for supporting said first levers and said wheels in said extended position of said cart.

12. The mechanism according to claim 11 and further comprising a third lever having one end pivotally connected to said opposite end of said second lever and the opposite end of said third lever is pivotally connected to said slidable anchor by said second pivot pin.

* * * * *